US005585771A

United States Patent [19]

Ervasti et al.

[11] Patent Number: 5,585,771

[45] Date of Patent: Dec. 17, 1996

[54] HELICAL RESONATOR FILTER INCLUDING SHORT CIRCUIT STUB TUNING

[75] Inventors: Kimmo Ervasti, Varjakka; Seppo Ojantakanen, Paavola, both of Finland

[73] Assignee: LK–Products Oy, Kempele, Finland

[21] Appl. No.: 363,234

[22] Filed: Dec. 23, 1994

[30] Foreign Application Priority Data

Dec. 23, 1993 [FI] Finland ..... 935841

[51] Int. Cl.[6] ..... H01P 1/20

[52] U.S. Cl. ..... 333/202; 333/219; 333/235; 333/206

[58] Field of Search ..... 333/202, 204, 333/219, 205, 235

[56] References Cited

U.S. PATENT DOCUMENTS

| | | | |
|---|---|---|---|
| 4,342,969 | 8/1982 | Myers et al. | 333/219 |
| 4,682,131 | 7/1987 | May | 333/202 |
| 4,977,383 | 12/1990 | Niiranen | 333/219 |
| 5,047,739 | 9/1991 | Kuokkanen | 333/202 |
| 5,432,489 | 7/1995 | Yrojölä | 333/202 |

FOREIGN PATENT DOCUMENTS

| | | | |
|---|---|---|---|
| 1049282 | 3/1951 | France . | |
| WO89/05046 | 1/1989 | WIPO | H01P 7/04 |

*Primary Examiner*—Benny Lee
*Assistant Examiner*—Darius Gambino
*Attorney, Agent, or Firm*—Darby & Darby, P.C.

[57] ABSTRACT

The present invention relates to a radio frequency filter the resonators (6,7) of which are made up of a wire wound into a cylindrical coil comprising a number of turns and of a surrounding casing (41). Finger-like projections (3) of an insulating plate (1) support the conical coils from the inside, and the coupling to the resonator is from a microstrip line (8), at a tap point (21), on the insulating plate. Each cylindrical coil has, adjoining the first turn, a straight portion (2) which is parallel to the axis of the cylindrical coil and extends towards the bottom plate (44) of the filter. On the inside surface of the bottom plate (44) there is a lead (51) one end (E) of which is short-circuited and the other end open, and the tip (12) of the straight portion (2) adjoining the cylindrical coil (6) is in contact with this lead (51). In this case, in spite of any rotation of the cylindrical coil relative to its own axis at the assembling stage of the filter, the distance of the tap point from the short-circuited end (E) of the lead (51) will remain unchanged, in which case the tap impedance will not change. The lead (51) is preferably a microstrip line on the surface of the insulating plate.

10 Claims, 3 Drawing Sheets

HELICAL RESONATOR FILTER INCLUDING SHORT CIRCUIT STUB TUNING

BACKGROUND OF THE INVENTION

The present invention relates to a radio frequency filter the resonator of which is made up of a wire wound into a cylindrical coil comprising a number of turns, of a casing surrounding the coil, and of an insulating plate supporting the cylindrical coil from the inside, and in which the signal lead is connected to the resonator coil via the insulating plate.

Because of their good electrical properties and light weight, filters comprising helix resonators are widely used in radio equipment. The resonator is a transmission line resonator, and it is made up of an approximately quarter-wave wire wound into a cylindrical coil disposed inside a grounded metal casing. The characteristic impedance of the resonator, and thereby its resonance frequency, is determined by the physical dimensions of the cavity, the ratio of the diameter of the helix coil to the inner dimension of the casing, and the distance of the turns of the coil from each other, i.e. the so-called pitch, and the support structure possibly used for supporting the coil. For this reason, preparing a resonator to resonate at precisely a desired frequency requires an accurate and precise structure.

A filter having desired properties can be constructed by series coupling of the resonators and by suitable arrangement of the coupling between them. With decreased filter sizes, especially in portable radio equipment, the precision requirements imposed on their manufacture and assembly increase drastically, since even small dimensional variations in the cavity, the cylindrical coil and the support structure greatly effect the resonance frequency. When a filter is coupled as part of the electrical circuit of a radio device, its input and output ports must be matched with the circuit, i.e. the impedances exhibited from the ports towards the filter are made the same as the impedances exhibited from the ports towards the circuit, so that reflections caused by a sudden change of impedance do not occur in the ports thereby reducing transmission losses. Likewise, the filter resonators must be matched with each other if a signal is introduced into the filter by physical coupling to its helix coil.

Thus a suitable impedance level must be found in the resonator, i.e. a physical connection point at which the impedance level from the connection point towards the resonator corresponds to the impedance level of the device to be coupled to it or of the adjacent resonator.

The impedance level of the connection point is directly proportional to the distance of the connection point from the short-circuited end of the resonator, in which case a higher or lower impedance level can be selected by changing the connection point on the helix coil. This matching is called tapping, since the connection point forms a tap from the helix resonator. The tap point may be determined experimentally or be calculated by using the resonator's calculated or measured characteristic impedance, which in turn is proportional to the electrical length of the resonator. Often the tap point in a helix resonator is on its first turn.

Tapping has conventionally been done by soldering, at the tap point, one end of a separate coil or wire to the wire forming the helix resonator. With decreasing filter sizes, the reproduction fidelity of such a tapping method is inadequate for mass production. Inadequate tapping accuracy results to a need for adjusting the taps in the process of tuning the filters; this slows down the tuning and increases costs.

An improved tapping method is described in Finnish patent 80542. The principle is shown in accompanying FIG. 1. The helix resonator 6 is disposed on a finger-like projection 3 of an insulating plate I in such a manner that the projection is within the resonator coil and supports the coil. At that end of the coil 6 which is towards the insulating plate 1, the beginning of the first turn is bent into a straight portion 2, the entire length of which is tightly against the surface of the insulating plate. The straight portion is called in the art the resonator leg. The end 7 of the portion 2 is in contact with the casing 5, being thereby short-circuited. The insulating plate has, at the base of the projection 3, a microstrip line 8 which is in contact with the rest of the resonator circuit or is part of a more extensive microstrip line pattern on the insulating plate. The microstrip line is parallel to the coil axis. The tap point is in this case the point at which the microstrip line 8 intersects with the straight portion 2 of the coil. The stripline and the straight portion are soldered to each other at this point. The tap point, and thereby the desired impedance level, is determined by moving the position of the microstrip line 8 in the lateral direction.

This method has the disadvantage that the changing of the impedance level of the tap point requires a large number of insulating plates different with respect to the lateral position of the microstrip line. This is a cost-increasing factor. Another disadvantage is that fine adjustment of the tap point is impossible, since the leg must come against the insulating plate. In practice the leg being against the insulating plate is not a very good solution, since the leg against a dissipative plate will increase resonator dissipation.

There is a well known prior art filter in which tapping is done on a stripline in contact with the edge of the finger-like projection described above. Such a filter is depicted in FIGS. 2, 3 and 4, in which the same reference numerals are used for applicable parts as in FIG. 1. FIG. 2 shows a part within the casing of a four-circuit filter, the part comprising four discrete helix resonators—separate reference is made to resonators 6 and 7—each of which is disposed around a finger-like projection 3 of the circuit board 1. In this case, the term used in the art is 'comb structure'. In the lower section 1A of the insulating plate 1 there is an electric circuit formed of striplines 8, 8', to which one or more resonators, such as resonator 6, is coupled at the tap point 21 by soldering. The tap point is here at the first turn of the coil, but it may just as well be higher. This possibility is illustrated by resonator 7 in FIG. 2, in which the tap point 22 is at the second turn of the coil. In this case the stripline extends somewhat upwards in the finger-like projection and ends at the projection edge, at which the soldering takes place to the resonator turn which is at that point. The tap point may thus be at any resonator turn, and there may be a number of tap points. The straight leg 2 of the resonator has, in a manner different from the leg in FIG. 1, been bent to be parallel to the resonator axis, running at a distance from the insulating plate, and at the assembling stage its other end connects to the bottom plate 31, FIG. 3, of the casing, and is thereby grounded if the plate is of metal. The bottom plate of the casing may also be made up of a circuit board of the radio device, at least one surface of the circuit board in the filter area being metallized throughout, in which case the tip of the leg is connected to the metallized surface.

FIG. 4 depicts a completed filter according to the state of the art, the filter casing 41 being shown partly as a cutaway so that the resonator is clearly visible. This filter has, between the circuits, partition walls, of which walls 42 and 43 are visible, which may have a coupling aperture (not shown in the figure) through which the circuit can be coupled by an electromagnetic field to the adjacent circuit. The partition wall has no significance in terms of the invention, nor does the manner in which the insulating plate supporting the resonators is attached to the casing walls. The casing 41 is most commonly an aluminum casing manufactured by extrusion, and the bottom plate 44 may be a metal plate or a circuit board one surface of which is metallized. The tap points 21 and 22 of the helix resonators 6 and 7 which are visible are indicated with black dots, and at this tap point the resonator connects to a stripline circuit (not shown in the figure) made in the lower section 1A anti fingers 3 of the insulating plate. The tips 12 and 13 of the legs 2 and 2' are soldered to the bottom plate 44 if the plate or its surface is of metal, or they are electrically connected to a metal foil on the opposite side of the bottom plate if the bottom plate is a circuit board.

The structure depicted in FIGS. 2 and 3 has certain disadvantages. In order for the tapping, and thereby the impedance exhibited at the tap point, to be precisely correct, the helix coil must be placed in precisely the correct position on the finger-like projection 3, so that the distance, measured along the coil, from the tap point to the grounded tip of the leg will be precisely correct. Even the slightest rotation relative to the axis of the coil will change the tap point and thereby the impedance. In the manufacturing of a filter, the position of the helix coil, when it is placed automatically on the projection, will vary owing to process variation, whereupon the electrical and physical height of the tap point from the ground potential will vary. In manufacture this will cause variation in the properties of filters. Control of the variation is very difficult, especially when the operation takes place at the limits of precision of the production process. So far, the only solution to this problem has been to make efforts to carefully control the precision of the process.

SUMMARY OF THE INVENTION

In accordance with a first aspect of the invention there is provided a filter comprising:

a conductive element grounded at a point; and a wound resonator adapted to be coupled at one end to any one of a range of positions on the conductive element each having a respective impedance to ground and to a circuit at a tapping point distance from the one end.

In accordance with a second aspect of the invention there is provided a filter comprising: at least one resonator formed from a wire wound into a cylindrical coil and which has, adjoining a first turn a straight portion substantially parallel to the axis of the coil; an insulating plate that supports the coil from within; a circuit for coupling to the resonator at a tapping point where the circuit and cylindrical coil are in contact; and a lead disposed on a bottom plate transverse to the axis of the coil, the lead being short-circuited at one end and open at the other positioned such that the tip of the straight portion contacts the lead.

The invention thus provides a filter which enables the tap impedance to remain substantially unchanged despite slight variation in the rotational position of the coil. The variation in the tap impedance during manufacture can be maintained at a very low level.

The bottom plate may be formed from an insulating material and the leads may be a microstrip line on the surface of the bottom plate which preferably, although not necessarily, follows a circle arc. The radius of curvature of the stripline may be the same as the distance of the tip of the resonator leg from the resonator axis. The width and thickness of the stripline can be selected freely, but its length is preferably less than a semi-circle arc, and it is located on the bottom plate on that side adjacent to the insulating plate supporting the resonators on which the resonator leg is located. The other end of the stripline may be electrically connected to a wall of the filter casing or to the continuous metal foil on the opposite side of the insulating plate, in which case it is thereby grounded. The partition wall has no significance in terms of the invention, nor does the manner in which the insulating plate supporting the resonators is attached to the casing wall.

When the helix coil is disposed on a finger-like projection of the insulating plate serving as the supporting structure, and is pressed into its final position, the tip of the leg will come into contact with the stripline. In this case the physical length from the tap point to the grounding point is the length of the resonator coil from the tap point to the tip of the leg plus the distance from the contact point between the tip and the stripline to the grounding point of the other end of the stripline. This desired physical length has been calculated in advance according to the desired tap impedance. When the resonator coil rotates relative to its vertical axis, the distance from the tap point to the tip of the leg decreases or increases, depending on the rotational direction. In this case the distance from the tip of the leg to the grounded end of the stripline will decrease or increase by an almost corresponding distance. Grounding is provided at that end of the stripline from which the distance to The tip of the leg increases when the distance from the tap point to the tip of the leg decreases. These changes of distance will cancel each other so that the tap impedance will remain unchanged irrespective of any rotation of the coil.

If the impedance between the resonator tap point and the tip of the leg is indicated by $Z_{res,low}$ and the impedance of the stripline part measured from the tip of the leg to the grounding point by $Z_{stripline}$, the tap impedance exhibited at the tap point is, simplified:

$$Z_{tap}=Z_{res,low}+Z_{stripline}$$

The invention thus provides a structure by which a change in the impedance $Z_{res,low}$, which change is due to productional variation in the placement of the helix coil on the finger of the insulating plate, is automatically compensated for by a change of corresponding magnitude but of opposite sign in the impedance $Z_{stripline}$.

If grounding is effected by short-circuiting that end of the stripline from which the electrical distance proportional to the impedance from the tap point to the tip of the leg increases when the distance from the tap point to the tip of the leg increases, an effect emphasizing the variation of the tap impedance is produced, since in this case the changes in the impedances $Z_{res,low}$ and $Z_{stripline}$ are of the same sign.

According to one embodiment of the invention, the electrical length of the stripline can be made adjustable, by for example changing the short-circuiting point. This may be achieved by grinding off parts of the stripline. In this case its electrical (and physical) length can be increased by grinding, whereupon the tap impedance will increase even if the contact point of the tip of the resonator leg does not change. A part of the stripline may also be replaced with a discrete inductive means such as a coil.

Instead of a stripline it is possible to use a metal wire attached to the bottom plate. If the bottom plate is a metal plate, the wire is placed at a distance from the plate surface, parallel to it. One end of the wire is bent and electrically connected, for example by soldering, to the plate. The other end may be attached to the plate via an insulating piece. The wire may be configured in similar ways to the stripline.

BRIEF DESCRIPTION OF THE DRAWINGS

The invention is described below in greater detail, with the help of FIGS. 5 to 8 of the accompanying drawings, of which:

FIG. 1 depicts a prior art resonator,

FIG. 2 depicts the resonators of a prior art four-circuit filter,

FIG. 3 is a side view of one resonators of FIG. 2,

FIG. 4 depicts a prior art filter, partly as a cutaway,

DETAILED DESCRIPTION OF THE INVENTION

Figure 1:
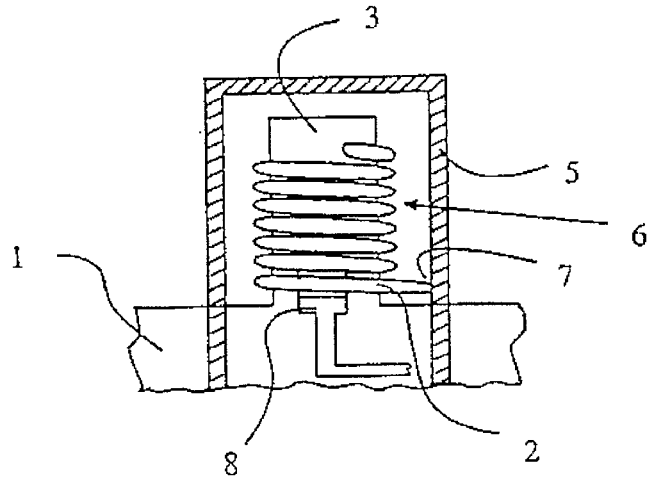
Fig. 1 PRIOR ART
FIGS. 1–4 illustrate prior art resonators have a tapping arrangement.
Figure 2:
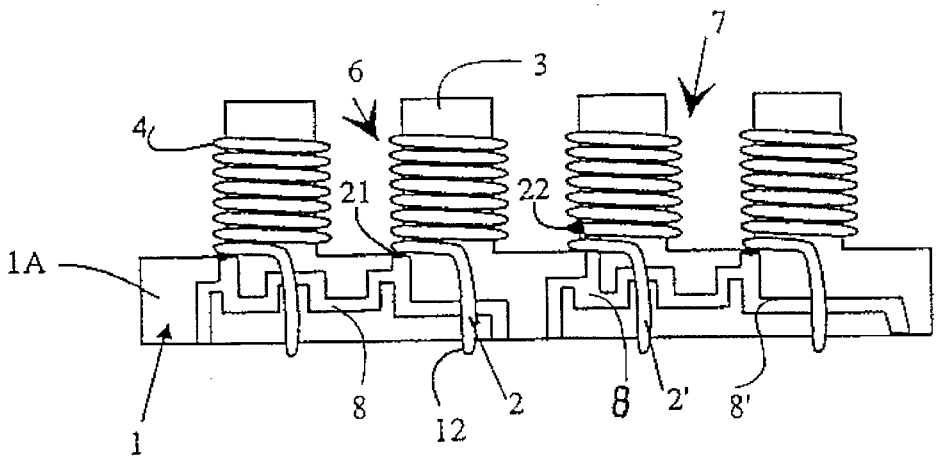
Fig. 2 PRIOR ART
Figure 3:
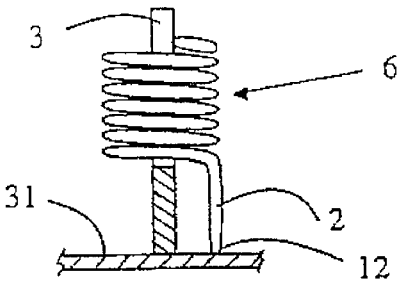
Fig. 3 PRIOR ART
Figure 4:
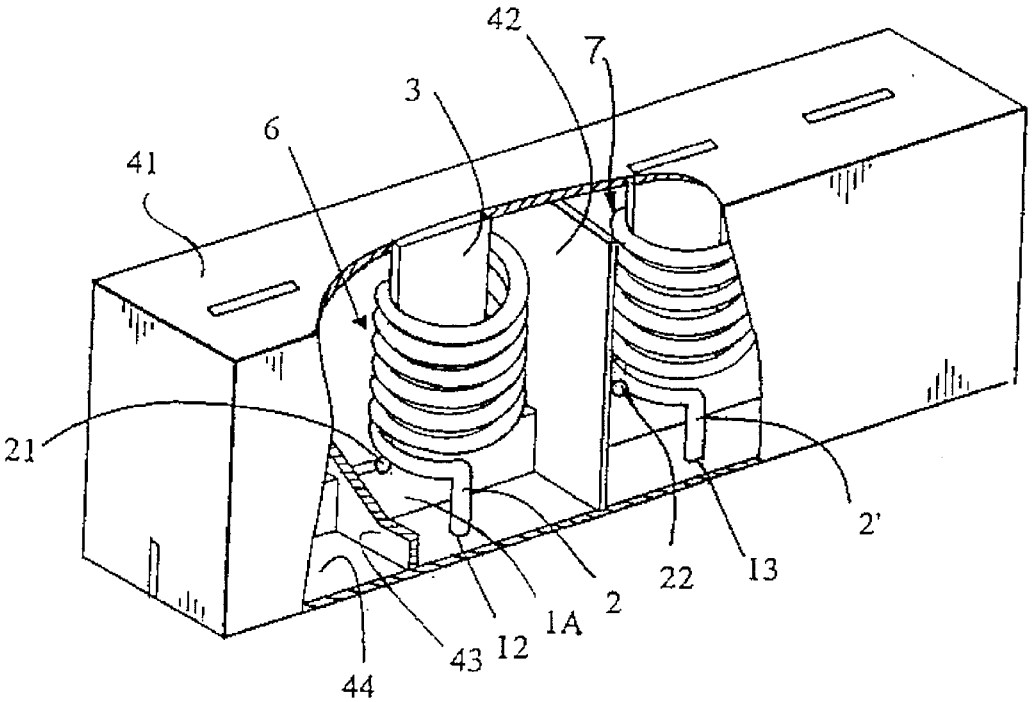
Fig. 4 PRIOR ART
Figure 5:
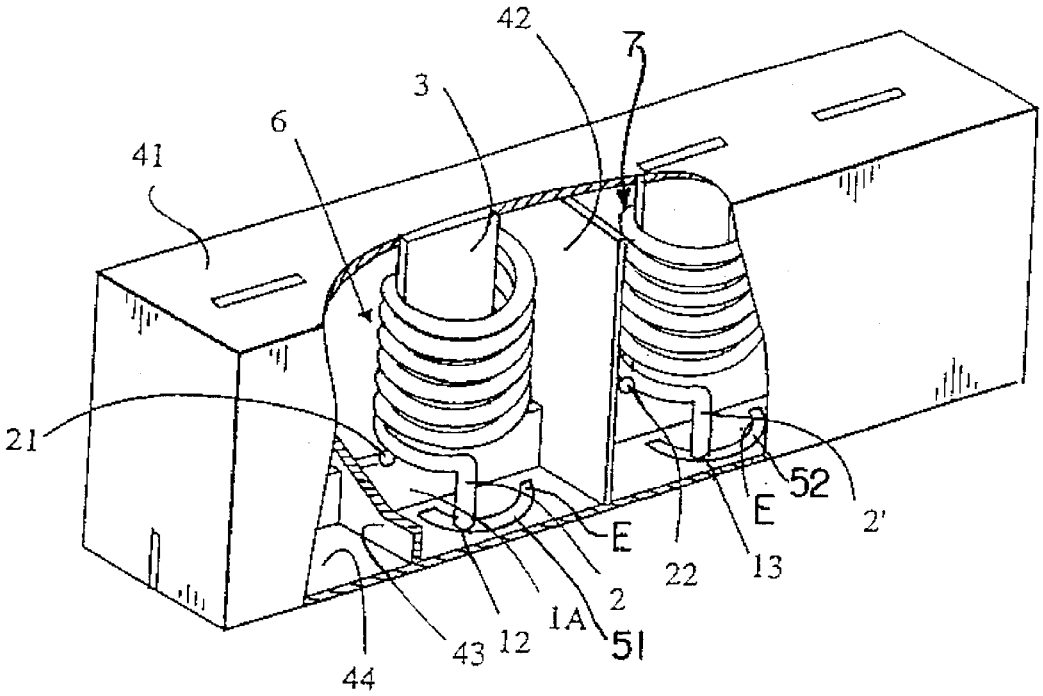
FIG. 5 depicts a filter of an embodiment of the invention.

FIG. 5, depicts a filter which has some structural similarities with the prior art filter of FIG. 4. Like parts are designated with like reference numerals. On the inner surface of the filter's insulating bottom plate 44 striplines to which the resonator legs are to be tapped are provided. Each of the resonators 6, 7 has a respective stripline 51, 52 on the bottom relate. These striplines preferably follow a circle arc, more precisely the circle arc plotted by the tip 12, 13 of a resonator leg 2, 2' when the resonator rotates about its longitudinal axis, the resonator being disposed on the finger-like projection 3. The stripline is, of course, on the same side of the bottom plate divided into two halves by insulating plate 1A as is the resonator leg.

One end of each of the striplines 51, 52 is short-circuited. The short-circuited end is indicated in FIG. 5 by reference E. If the bottom plate is a circuit board the outer surface of which is entirely metallized, the short-circuiting (grounding) can be effected by connecting the end E of the stripline directly through the circuit board to the metallization. Grounding can also be effected by connecting the stripline end inside the bottom plate to the metallic wall of the casing, either to a side wall or a partition wall possibly between the circuits. For short-circuiting the stripline end there are many solutions evident to the man skilled in the art.

The tap impedance $Z_{tap}$, for example in resonator 6, has at the planning stage been calculated so that it corresponds to a physical distance from the tap point 21 to the tip 12 of the leg 2 plus the distance from the contact point between the tip 12 of the leg 2 and the stripline 51 in the bottom plate to the short-circuited end E of the strip-line.

Figure 6:
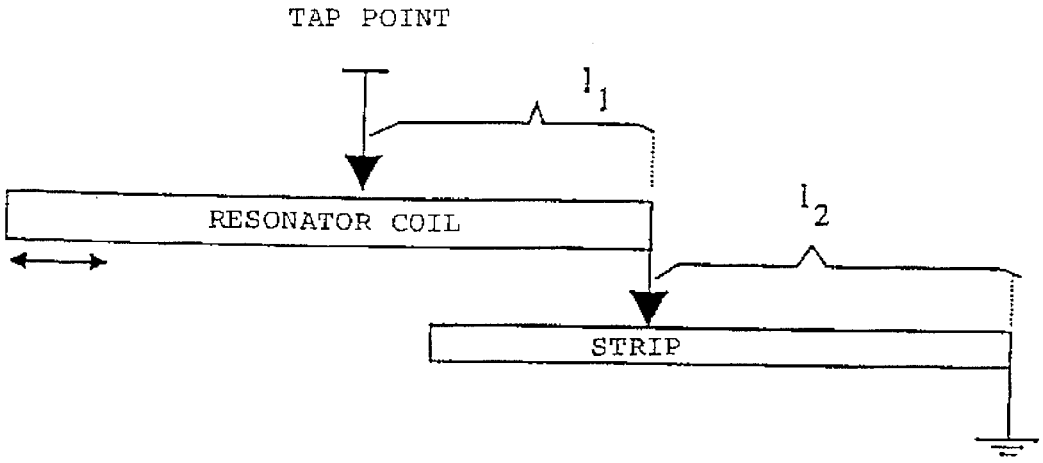
FIG. 6 is a schematic representation of the principle of the invention.

During filter assembly the helix coil is placed on the projection 3 of the insulating plate. The topmost line segment of FIG. 6 shows the physical length of the helix coil. At a certain point there is the tap point, for example point 21 in FIG. 5. Since the tapping is done to a stripline on a circuit board, this point is a fixed point with respect to the helix coil. The distance from this point along the resonator to the tip of its leg is $\mathbf{1}_1$, and this distance corresponds to certain impedance $Z_{res,low}$. This distance changes according to how the resonator coil rotates about its axis during installation. The distance from the contact point between the tip 12 of the resonator leg and the stripline along the stripline to its short-circuited end is $\mathbf{1}_2$, and this distance is corresponded to by an impedance $Z_{stripline}$ determined by the dimensions of the stripline. The stripline is fixed, with respect to the resonator coil, and therefore, when the resonator coil rotates, the contact point slides on the stripline. As the dimension $\mathbf{1}_2$ changes, the impedance $Z_{stripline}$ changing correspondingly. The impedance $Z_{tap}$ of the tap point is proportional to the total length $1_1+1_2$, in which case $Z_{tap}=Z_{res,low}+Z_{stripline}$ applies with sufficient precision.

When, for example, the resonator coil 6 is being disposed on the projection 3, it may happen that it rotates from the set position so that the leg 2 in FIG. 5 turns to the left. According to FIG. 6 this means that distance $\mathbf{1}_1$ decreases. But distance 12 increases correspondingly. The changes in the distances almost completely cancel each other, and so the total distance sum $1_1+1_2$ remains unchanged, from which it follows that the tap impedance $Z_{tap}$ will not change. Respectively, if the leg 2 in FIG. 5 turns to the right at the installation stage, $\mathbf{1}_1$ increases but $\mathbf{1}_2$ decreases by the corresponding amount, and so the total impedance $Z_{tap}$ will remain unchanged.

In practice the resonator leg 2 should not be very close to the insulating plate 1A owing to the microstrip lines on it. If the leg is very close, during reflow soldering the paste may rise up between the leg and the insulating plate and short-circuit the leg to the lead patterns on the insulating plate. In practice the leg may be located in a sector perpendicular to the insulating plate 1A, the sector being 45 degrees. This means that the open end of the stripline on the bottom plate need not extend outside this sector.

It is also possible to ground one end of the stripline and leave open the grounded end described in the above description and FIG. 6. This means, as can be easily concluded from FIG. 6, that the rotation of the resonator coil so that the leg 2, (FIG. 5) turns to the left, will strongly decrease the tap impedance. Correspondingly rotation of the coil so that the leg 2 turns to the right rapidly increases the tap impedance. Thus, grounding at this end produces an effect which emphasizes variation.

Figure 7:
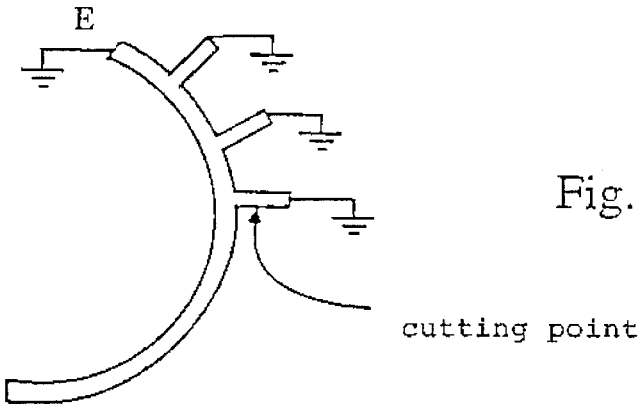
FIG. 7 is another embodiment of the invention.

In one embodiment the length of the stripline on the bottom plate may be made adjustable. According to FIG. 7, which depicts a plan view of the stripline, tabs with one end grounded have been made in the stripline. The grounded end is indicated by reference E. By cutting groundings from the direction of the resonator coil the length of the stripline can be increased and thus the tap impedance be increased, should this be necessary in tuning up a completed product. Instead of tabs it is possible to use through coppered holes disposed along the length of the stripline, the holes connecting the stripline to the metal foil on the opposite side of the plate. By drilling holes open the electric contact in the area of the hole can be disconnected, and thus the electrical length of the stripline can be increased. The various possibilities are known to the man skilled in the art.

In view of the foregoing description it will be evident to a person skilled in the art that various modifications may be made within the scope of the invention.

The scope of the present disclosure includes any novel feature or combination of features disclosed therein either explicitly or implicitly or any generalisation thereof irrespective of whether or not it relates to the claimed invention or mitigates any or all of the problems addressed by the present invention.

Figure 8:
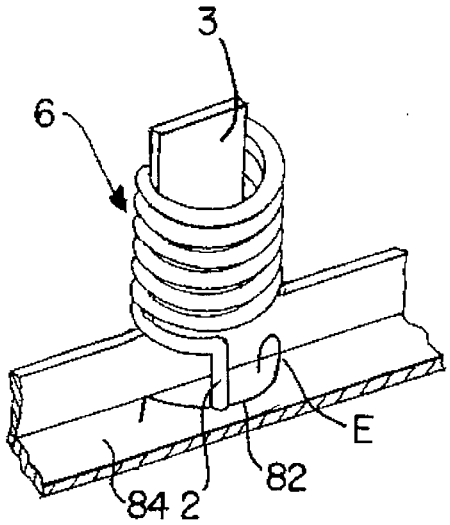
FIG. 8 is another embodiment.

In particular, in the examples described above, a stripline has been used. While remaining within the scope of protection of the invention it is also possible to use other methods of implementation. Instead of the stripline it is possible to use a rigid metal wire which is on the surface of the insulating plate in close contact with the plate. The wire may also be at some distance from the surface of the plate and the ends of the wire be attached to the plate and one end be in addition, short-circuited. This alternative is shown in FIG. 8. If the bottom plate 84 of the filter is a metal plate, the wire 82 is a usable solution. In this case, one end of the wire may be electrically connected directly to the bottom plate, the grounded ends being indicated by E, and the other end may be attached to it with insulation. In this case the resonator leg 2 will not extend all the way to the bottom plate 84; it touches the wire 82, to which it is electrically connected after the soldering process.

What is claimed is:

1. A resonator filter comprising:

a conductive element grounded at a point and having an impedance to ground that increases with distance of a position from the point; and a wound resonator having one end adapted to be coupled to any one of a range of the positions on the conductive element, said wound resonator further having a tapping point at a distance from the one end for connection to a utilization circuit, whereby the impedance from the tapping point to ground is equal to the sum of the impedance from the tapping point to the end of the wound resonator and the impedance from the one position on the conductive element to ground.

2. A filter according to claim 1 wherein the conductive element is configured to follow the path traced by the one end of the wound resonator as the relative position of the wound resonator to the tapping point is changed so the tapping point between the circuit and the wound resonator is varied along a winding of the wound resonator.

3. A resonator filter according to claim 2 wherein the conductive element is grounded such that the distances between the tapping point and the end of the wound resonator and between the end of the wound resonator and ground change in opposing senses as the position of the tapping is varied thereby maintaining the impedence to ground at the tapping point substantially constant.

4. A resonator filter according to claim 1 wherein the conductive element is a microstrip line disposed on an insulative surface.

5. A resonator filter according to claim 1 wherein the conductive element is a conductive wire disposed parallel to a conductive surface, the conductive element being electrically coupled to a conductive plate at a point.

6. A resonator filter according to claim 1 wherein the position of the tapping point of the resonator is adjusted by rotation of the resonator about its axis and wherein the conductive element has a radius of curvature substantially equivalent to the distance between the end of the wound resonator and its axis.

7. A resonator filter according to claim 1 wherein the filter comprises a bottom plate, an insulating plate that supports the resonator from within, the insulating plate being transverse to the bottom plate, the wound resonator being a cylindrical coil and having, adjacent a first turn, a straight portion terminating at the one end substantially aligned with the axis of the coil and extending towards the bottom plate.

8. A resonator filter according to claim 1 wherein the position of the grounding point of the conductive element is changeable.

9. A resonator filter according to claim 8 wherein the position of the grounding point is selectable from a set of ground point positions.

10. A resonator filter comprising:

at least one resonator formed from a wire wound into a cylindrical coil providing a plurality of windings and which has, adjoining a first turn a straight portion substantially parallel to the axis of the coil;

an insulating plate that supports the coil from within;

a circuit for coupling to the resonator at a tapping point on one of the plurality of windings where the circuit and cylindrical coil are in contact; and a lead disposed on a bottom plate transverse to the axis of the coil, the lead being short-circuited at one end and open at the other end and positioned such that the tip of the straight portion contacts the lead.

* * * * *